US006842149B2

(12) United States Patent
Taubman

(10) Patent No.: US 6,842,149 B2
(45) Date of Patent: Jan. 11, 2005

(54) COMBINED MECHANICAL PACKAGE SHIELD ANTENNA

(75) Inventor: Irving Louis Taubman, Belmont, CA (US)

(73) Assignee: Solectron Corporation, Milpitas, CA (US)

( * ) Notice: Subject to any disclaimer, the term of this patent is extended or adjusted under 35 U.S.C. 154(b) by 0 days.

(21) Appl. No.: 10/350,627

(22) Filed: Jan. 24, 2003

(65) Prior Publication Data

US 2004/0145533 A1 Jul. 29, 2004

(51) Int. Cl.[7] ..... H01Q 1/24
(52) U.S. Cl. ..... 343/702; 343/841
(58) Field of Search ..... 343/702, 793, 343/841; 455/90

(56) References Cited

U.S. PATENT DOCUMENTS

| | | | | |
|---|---|---|---|---|
| 5,054,120 A | | 10/1991 | Ushiyama et al. | 455/351 |
| 5,541,613 A | | 7/1996 | Lam et al. | 343/792.5 |
| 5,541,614 A | | 7/1996 | Lam et al. | 343/792.5 |
| 5,600,342 A | | 2/1997 | Pikulski et al. | 343/909 |
| 5,696,517 A | | 12/1997 | Kawahata et al. | 343/700 MS |
| 5,760,746 A | | 6/1998 | Kawahata | 343/702 |
| 5,797,084 A | | 8/1998 | Tsuru et al. | 455/73 |
| 5,818,309 A | | 10/1998 | De Los Santos | 333/176 |
| 5,946,194 A | | 8/1999 | Dudas et al. | 361/737 |
| 5,966,098 A | | 10/1999 | Qi et al. | 343/702 |
| 5,973,651 A | | 10/1999 | Suesada et al. | 343/752 |
| 5,977,917 A | * | 11/1999 | Hirose | 343/702 |
| 6,002,369 A | | 12/1999 | Richard | 343/700 MS |
| 6,008,761 A | | 12/1999 | Harano | 343/366 |
| 6,011,519 A | | 1/2000 | Sadler et al. | 343/742 |
| 6,016,126 A | | 1/2000 | Holshouser | 343/702 |
| 6,054,954 A | | 4/2000 | Eggleston et al. | 343/700 MS |
| 6,061,024 A | | 5/2000 | McGirr et al. | 343/700 MS |
| 6,069,587 A | | 5/2000 | Lynch et al. | 343/700 MS |
| 6,154,177 A | | 11/2000 | Saito et al. | 343/702 |
| 6,184,834 B1 | | 2/2001 | Utsumi et al. | 343/702 |
| 6,198,943 B1 | | 3/2001 | Sadler et al. | 455/553 |
| 6,215,447 B1 | | 4/2001 | Johnson | 343/702 |
| 6,225,952 B1 | | 5/2001 | Harano | 343/702 |
| 6,239,753 B1 | | 5/2001 | Kado et al. | 343/702 |

(List continued on next page.)

FOREIGN PATENT DOCUMENTS

EP 1331688 A1 7/2003

OTHER PUBLICATIONS

Jesse Drucker and Julia Angwin, New Way to Surf the Web Gives Cell Carriers Static, The Wall Street Journal On Line, Nov. 29, 2002, pp. 1–5, Copyright 2002 Dow Jones & Company, Inc., US.

David F. Gallagher, Shrinking and Rethinking the Old Vertical Antenna, Mar. 7, 2002, pp. 1–3, Copyright 2002, The New York Times Company, US.

*Primary Examiner*—Hoang V. Nguyen
(74) *Attorney, Agent, or Firm*—Robert Moll

(57) ABSTRACT

The present invention relates to antennas for radio signal frequencies, an electromagnetic shield and a mechanical package for electronic components. The antenna uses a three-dimensional conductive structure to enclose the components that are used for the transmission and reception of wireless devices. This conductive structure preferably encloses electronic components. The structure can be divided into two or more sections such that each section is enclosed providing shielding from external electromagnetic fields. Each conductive section is connected to the antenna port or ports of the device it contains. The conductive mechanical package is preferably sized to resonant at the desired frequency of operation. If the electromagnetic fields to be radiated are within and outside the package, the internal bulkheads can be used to control the desired resonant modes. Photonic band gap structures can be also used to connect the pole elements.

9 Claims, 7 Drawing Sheets

U.S. PATENT DOCUMENTS

| | | | | |
|---|---|---|---|---|
| 6,239,765 | B1 | 5/2001 | Johnson et al. | 343/795 |
| 6,252,552 | B1 | 6/2001 | Tarvas et al. | 343/700 MS |
| 6,259,407 | B1 | 7/2001 | Tran | 343/700 MS |
| 6,262,682 | B1 | 7/2001 | Shibata | 343/700 MS |
| 6,266,020 | B1 | 7/2001 | Chang | 343/702 |
| 6,266,538 | B1 | 7/2001 | Waldron | 455/550 |
| 6,268,831 | B1 | 7/2001 | Sanford | 343/702 |
| 6,271,794 | B1 | 8/2001 | Geeraert | 343/700 MS |
| 6,271,796 | B1 | 8/2001 | Itoh et al. | 343/702 |
| 6,271,803 | B1 | 8/2001 | Watanabe et al. | 343/895 |
| 6,281,848 | B1 | 8/2001 | Nagumo et al. | 343/700 MS |
| 6,281,850 | B1 | 8/2001 | Klostermann | 343/702 |
| 6,285,327 | B1 | 9/2001 | See | 343/702 |
| 6,285,328 | B1 | 9/2001 | Masaki et al. | 343/702 |
| 6,288,680 | B1 | 9/2001 | Tsuru et al. | 343/702 |
| 6,320,548 | B1 | 11/2001 | Harrell et al. | 343/700 MS |
| 6,329,950 | B1 | 12/2001 | Harrell et al. | 343/700 MS |
| 6,424,317 | B2 | 7/2002 | Rudish | 343/395 |
| 6,518,931 | B1 | 2/2003 | Sievenpiper | 343/770 |
| 6,650,291 | B1 | 11/2003 | West et al. | 342/371 |
| 6,674,949 | B2 | 1/2004 | Allan et al. | 385/129 |
| 2001/0050641 | A1 | 12/2001 | Itoh et al. | 343/700 MS |
| 2003/0049003 | A1 | 3/2003 | Ahmad et al. | 385/123 |

* cited by examiner

COMBINED MECHANICAL PACKAGE SHIELD ANTENNA

BACKGROUND

The present invention relates to antennas for radio signal frequencies, an electromagnetic shield, and a mechanical package for electronic components.

One of the fast growing segments of the computer industry today is wireless networks. Wireless networks avoid the cost of the wiring infrastructure, and permit computing mobility. Some of the more common wireless networks are based on the 802.11 standard, Bluetooth, cellular networks, i-mode, and WAP. Cell phones are in use nearly everywhere. Some standards such as 802.11, also known as wireless Ethernet or Wi-Fi, are also ubiquitous and can be found in many companies, offices, airports, and even coffee shops. With Wi-Fi you only need to be in range of a peer or a base station which connects the wireless network to a wired one. Thus, a person can carry Wi-Fi enabled personal digital assistant (PDA) or a notebook computer about without giving up his or her network connection. Bluetooth is another known wireless standard designed for interconnection of computing devices such as computer peripherals.

No matter what wireless standard is used, there is a fundamental need to increase antenna performance. Wireless devices emphasize compactness, however, which impacts performance. For example, if an embedded antenna is placed on a printed circuit board in close proximity to the ground plane or adjacent metal objects, the antenna performance will be degraded. The ground plane will reduce the antenna's radiation resistance, which lowers the antenna efficiency and adversely affects the antenna gain pattern. In addition, a completely shielded mechanical package will prevent the antenna from propagating the radio through the shield. Yet, the transceiver must be shielded from stray electromagnetic fields. The shield for the transceiver will also function as a ground plane in close proximity with the antenna. Again, this degrades the antenna performance. Further, the antenna performance generally increases with the length of the radiating elements of the antenna, but this means the printed circuit board will need to increase in size, which conflicts with the small size requirements of mobile devices.

FIG. 1A illustrates how an embedded antenna 14 might be configured for a cell phone to try to address these problems. As shown, the printed circuit board 20 supports a set of electronic components such as the electronic component 22. A mechanical package 10 encloses the printed circuit board 20. FIG. 1A cuts away a portion of the mechanical package 10 to show the inside of the cell phone. The antenna 14 is adjacent to an area (indicated by dotted lines 12) where the ground plane is removed in the printed circuit board 20. This removal avoids a ground plane in close proximity to the antenna 14, which would interfere with the antenna pattern. The mechanical package 10 must be also non-conductive to avoid shielding the antenna 14. Because the mechanical package 10 is non-conductive, a radiation shield 18 must enclose the RF transceiver chips 16, 17, which are sensitive to stray electromagnetic radiation. FIG. 1A also cuts away the radiation shield 18 to show the RF transceiver chips 16, 17. The antenna 14 must not be too close to electronic components on the printed circuit board 20 or to the radiation shield 18 to avoid affects on the antenna pattern. As a result of these constraints, the manufacturer will need to increase the size of the printed circuit board 20 and the mechanical package 10.

FIG. 1B illustrates how a protruding antenna 15 might be configured for a cell phone in another attempt to address these problems. The printed circuit board 20 again supports electronic components such as the electronic component 22. A mechanical package 24 encloses the printed circuit board 20, but is cut-away in FIG. 1B to show the inner arrangement. The antenna 15 is placed outside the mechanical package 24 so there is no longer the need to remove the ground plane of the printed circuit board 20 as indicated by the absence of dotted lines. The mechanical package 24 also can be conductive because it will no longer shield the antenna 15. Further, if the mechanical package 24 is non-conductive, a radiation shield 18 must enclose the RF transceiver chips 16, 17, which are sensitive to stray electromagnetic fields. FIG. 1A cuts away part of the radiation shield 18 to reveal the RF transceiver chips 16, 17. However, these advantages are dampened because the protruding antenna 15 must now be small enough to avoid user discomfort, and more rugged since it is outside the protection of the mechanical package 24. This raises the cost of the antenna 15 and limits suitable size and shapes of the antenna.

It would be desirable if an antenna could propagate electromagnetic radiation at frequencies of interest, shield against any stray electromagnetic radiation, save printed circuit space, reduce ground plane interference, and provide a rugged low cost mechanical package for the wireless device itself.

SUMMARY OF THE INVENTION

This invention uses a three-dimensional conductive structure to enclose the components that are used for the transmission and reception of wireless devices. This conductive structure preferably forms a mechanical package with the electronic components inside it. In one embodiment, the structure is divided into two or more sections by conductive bulkheads such that each section is completely enclosed providing shielding from external electromagnetic fields. Each conductive section is connected to the antenna port or ports of the device it contains. The conductive mechanical package is preferably sized to resonant at the desired frequency of operation The electromagnetic fields to be radiated can exist on the inside and outside, or just on the surface of the package. If the electromagnetic fields to be radiated are within and outside the package, internal bulkheads can be used to control the desired resonant modes. In another feature, photonic band gap ground plane printed circuit boards can be used to connect separated sections of the conductive structure.

DETAILED DESCRIPTION OF THE PREFERRED EMBODIMENTS

Figure 1A:
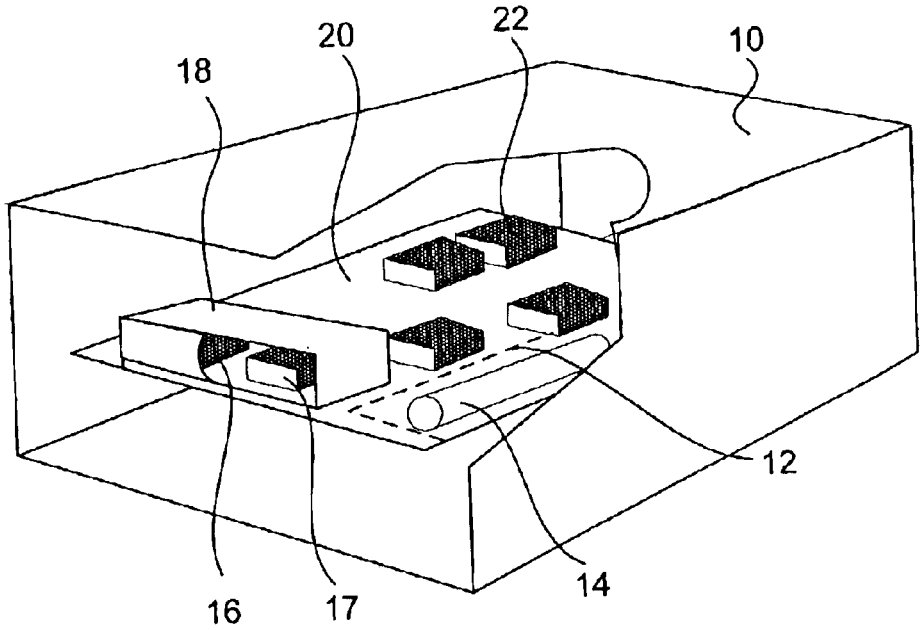
FIG. 1A illustrates an antenna embedded in a mechanical package.
Figure 1B:
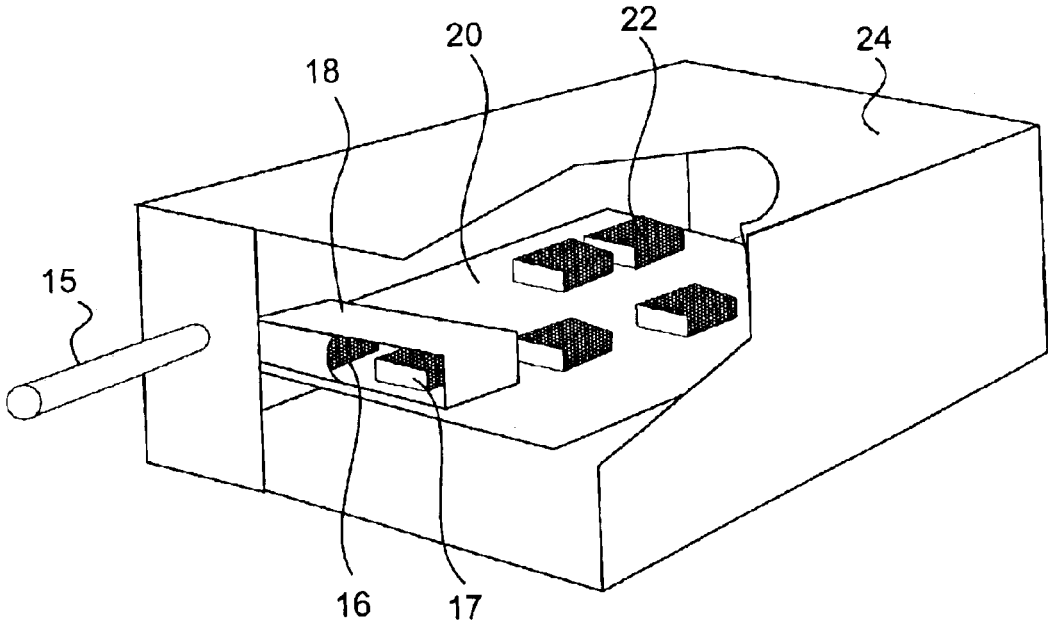
FIG. 1B illustrates an external antenna protruding beyond the mechanical package.

The following description includes the best mode of carrying out the invention. The detailed description is made for the purpose of illustrating the general principles of the invention and should not be taken in a limiting sense. The scope of the invention is best determined by reference to the claims. Each part, even if structurally identical to other parts, is assigned its own part number to help distinguish where the part appears in the drawings.

Figure 2:
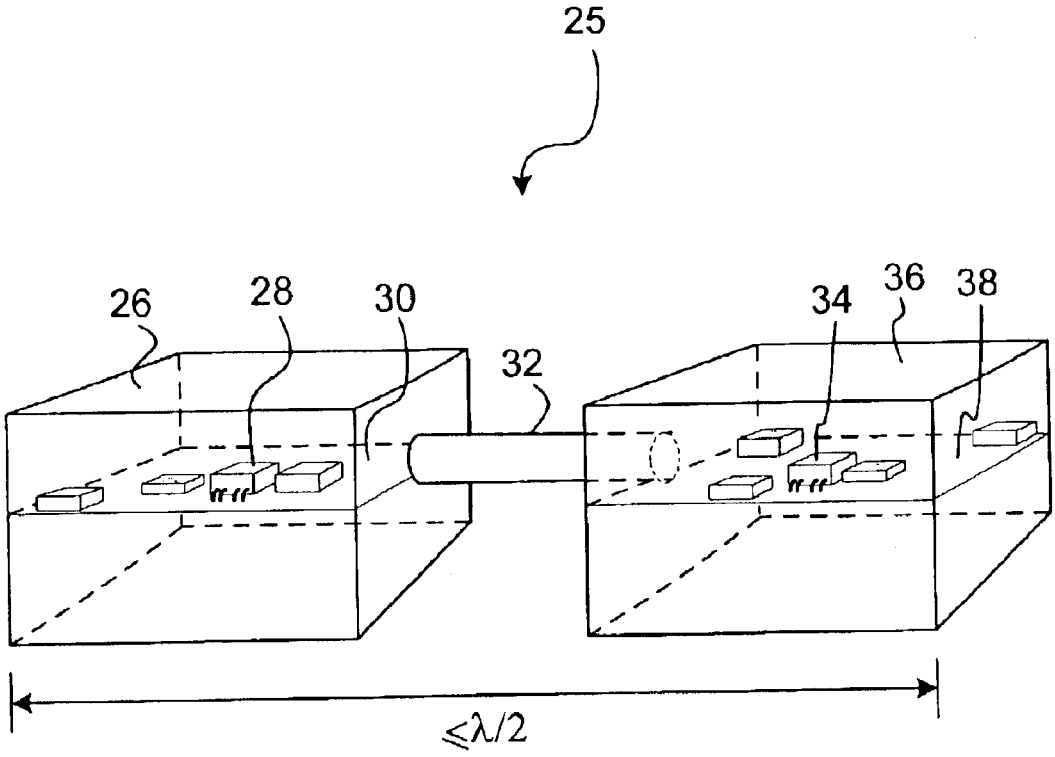
FIG. 2 illustrates an embodiment of the antenna that also functions as a mechanical package and an electromagnetic shield.

FIG. 2 shows an embodiment of an antenna 25 functioning as a mechanical package and an electromagnetic shield for the associated electronics. As shown FIG. 2, the antenna 25 is no longer mounted on a printed circuit board 30 or printed circuit board 38 as shown in FIG. 1A. This expands available space on the printed circuit boards 30, 38 for added circuitry and electronic components such as the electronic components 28, 34. The antenna 25 also no longer protrudes beyond the mechanical package, because the package is the antenna 25. This reduces manufacturing costs by eliminating the cost of a separate conventional antenna and permits using conductive materials for the mechanical package shown here as combination of the pole element 26, the pole element 36, and the pole interconnect 32 without degrading the performance of antenna 25 by acting as a ground plane in close proximity. Because the antenna 25 is also the mechanical package, the invention permits an increase in the size of the radiating pole elements 26, 36, without extending the structure of the antenna 25 beyond the shape of the mechanical package. This has advantages for wireless applications such as cell phones. The antenna 25 also fully encloses the printed circuit boards 30 and 38, which permits the antenna 25 to act as an electromagnetic shield against stray electromagnetic radiation which can cause interference.

It can be understood by review of the specification that the antennas 25 can be made from a variety of materials including metals such as copper, aluminum, steel, or brass. In addition, the antenna 25 might be made from a metallized plastic, a conductive plastic, a conductive ceramic, a conductive composite, or any other suitable conductive materials useful for antennas, packaging and electromagnetic shielding of electronic components.

If the antenna 25 is made of a metal, the sides of the pole elements 26, 36, can be sealed by metal fasteners, brazing, welding, soldering, etc. The material and techniques used will be guided by manufacturing requirements. For example, the thickness of the walls of the antenna 25 will be a function of the material, the characteristics of the antenna, the amount of electromagnetic shielding required, and the cost of the material. If the antenna material is a relative good conductor, for example, such as copper, the walls can be relatively thin. Conversely, if the material is a relatively poor conductor, such as steel, the walls will be necessarily thicker to achieve an adequate electromagnetic shield.

FIG. 2 depicts the pole elements 26 and 36 as hollow cubes, but they could be other closed surface figures. For example, the pole elements 26 and 36 might be a rectangular prism, a square pyramid, a cylinder, a right circular cone or a sphere, etc. However, whatever shape is selected, it is preferred that the pole elements 26 and 36 of the antenna 25 enclose the printed circuit boards 30 and 38 to shield against stray electromagnetic radiation reaching the electronic components. Further, as shown in FIG. 2, the length of the antenna 25 is preferably $\leqq\lambda/2$, where $\lambda$ is the wavelength of the radiation propagated by the antenna 25.

Figure 3A:
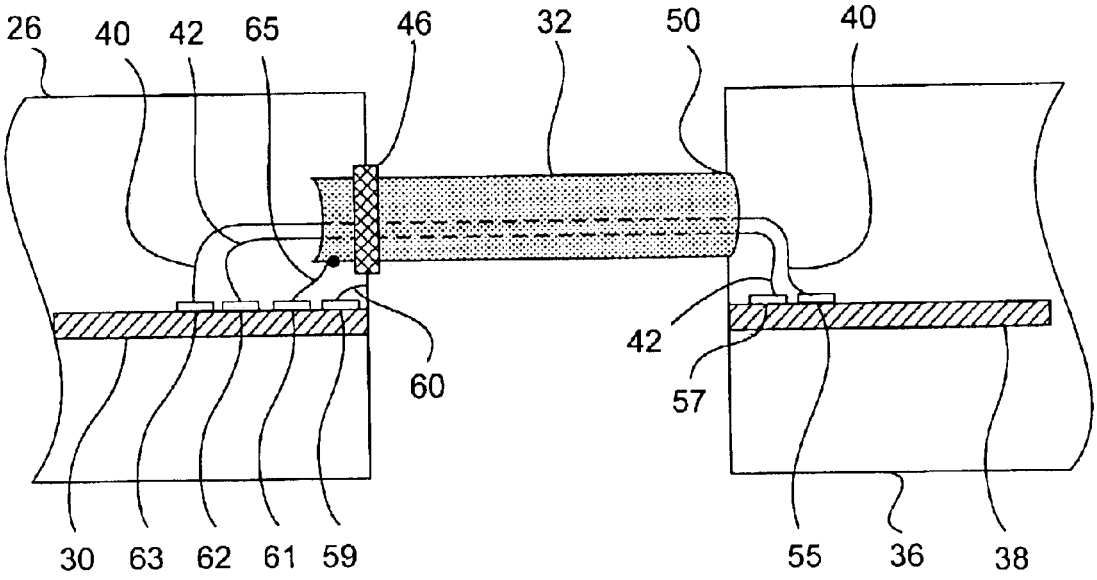
FIG. 3A is an elevation view of the antenna illustrated in FIG. 2 showing an embodiment for wiring the components between the printed circuit boards.

FIG. 3A is an elevation view of the antenna illustrated in FIG. 2 showing an embodiment for wiring the components between the printed circuit boards. As shown, the interconnect 32 mechanically joins the pole element 26 to the pole element 36. A solder joint 50 attaches one end of the interconnect 32 to the pole element 36, while an insulator 46 spaces and holds the other end of the interconnect 32 in the hole in the pole element 26. As an alternative, see FIG. 2 where the end of interconnect 32 is substantially flush with the pole element 26. The pole element 26 encloses the printed circuit board 30, while the pole element 36 encloses a printed circuit board 38. The interconnect 32 also protects and shields a set of wires represented by a data line 40 and a power line 42. One end of the data line 40 electrically connects, e.g., by soldering it, to a pad 63 on the printed circuit board 30. The other end of the data line 40 electrically connects to a pad 55 on the printed circuit board 38. One end of the power line 42 electrically connects to a pad 62 on the printed circuit board 30. The other end of the power line 42 electrically connects to a pad 57 on the printed circuit board 38. The antenna 25 includes a low-side pole wire 65, which is soldered to the interconnect 32 and to a low-side pad 61. The antenna also includes a high-side pole wire 60, which is soldered to the pole element 26 and to the high-side pad 59. Upon review of the specification, it would be understood that different wiring configurations are possible. For example, there can be a different number of wires running inside the interconnect 32, and the polarities could be reversed, and/or different techniques can be used to connect the wiring.

Figure 3B:
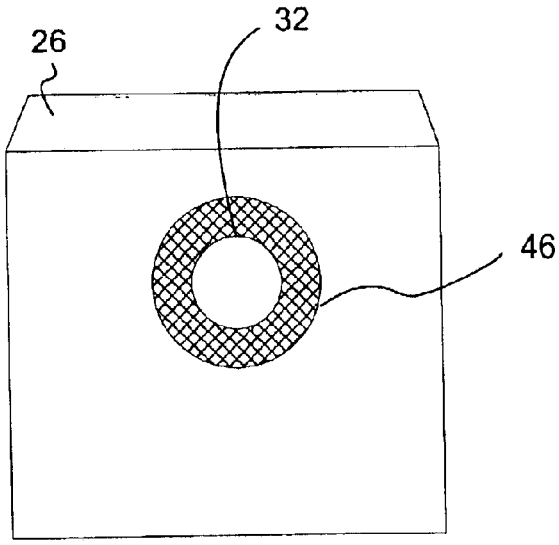
FIG. 3B is an end view of one pole element of the antenna shown in FIG. 3A.

FIG. 3B is an end view showing the insulator 46 spacing the interconnect 32 from touching the pole element 26 of the antenna shown in FIG. 3A.

Figure 4A:
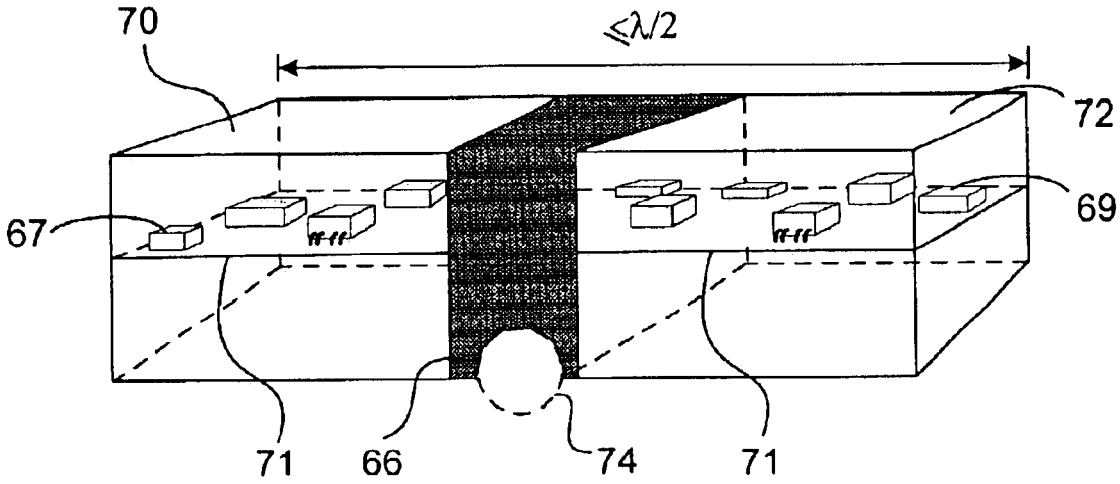
FIG. 4A is an embodiment of an antenna with a photonic band gap structure.

FIG. 4A is an embodiment of an antenna with a photonic band gap structure 66. The photonic band gap structure 66 rejects unwanted frequencies by acting as an electromagnetic shield as will be explained. The antenna is made as described in connection with FIGS. 2 and 3A, but removes the opposite adjacent sides of the pole elements there to form the pole elements 70 and 72. The pole elements 70 and 72 and the photonic band gap 66 enclose a single printed circuit board 71, which in turn supports electronic components such as the electronic components 67 and 69. In an alternative embodiment, the photonic band gap 66 can be replaced with an insulator, and the pole elements closed, that is, have six sides not five, and the interconnect 32 reintroduced as shown in FIGS. 2 and 3A–3B. As discussed earlier, the length of the antenna is again preferably $\leqq\lambda/2$, where $\lambda$ is the wavelength of the radiation propagated by the antenna.

Figure 4B:
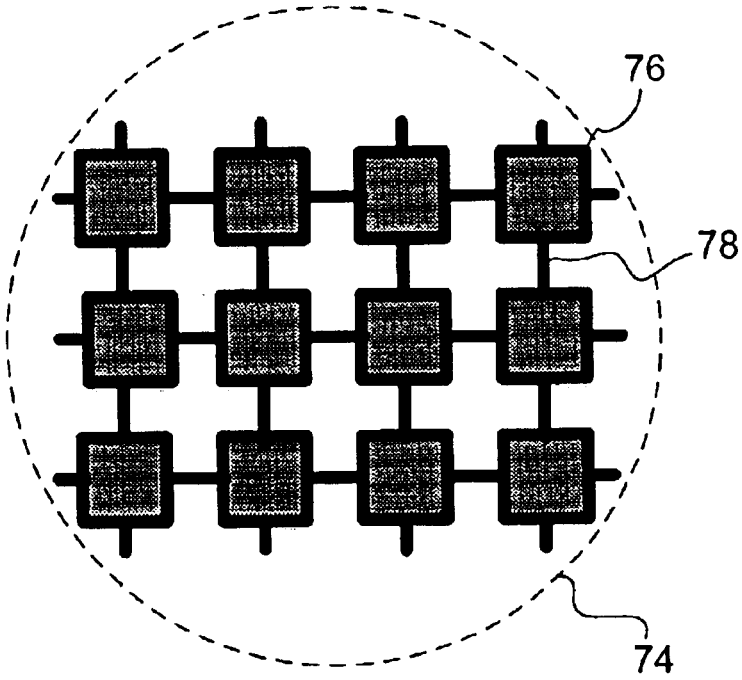
FIG. 4B magnifies part of the photonic band gap structure shown in FIG. 4A.

FIG. 4B enlarges part (dotted lines 74) of the photonic band gap structure shown in FIG. 4A. The photonic band gap 66 includes a periodic lattice structure of photonic band gap cells 76 and photonic band gap cell interconnects 78. To the unwanted frequencies, the photonic band gap 66 conducts so that the pole element 70, the pole element 72, and the photonic band gap 66 together act as an electromagnetic shield. To the frequencies of electromagnetic wave that are to be transmitted and received by the antenna, the photonic band gap 66 functions as an insulator so that the antenna has functionally speaking no conducting structure between the pole elements 70 and 72.

Sievenpiper et al., "High-Impedance Electromagnetic Surfaces with a Forbidden Frequency Band" (IEEE Trans. on Microwave Theory and Techniques, Vol. 47, No. 11, Nov. 1999) describe suitable photonic band gap structures that could be used, which article is incorporated herein by reference. This embodiment is particularly useful when a given application requires that the circuitry reside on a single printed circuit board 71 rather than on a set of physically separate printed circuit boards 30 and 38 as shown in FIG. 2.

Figure 5:
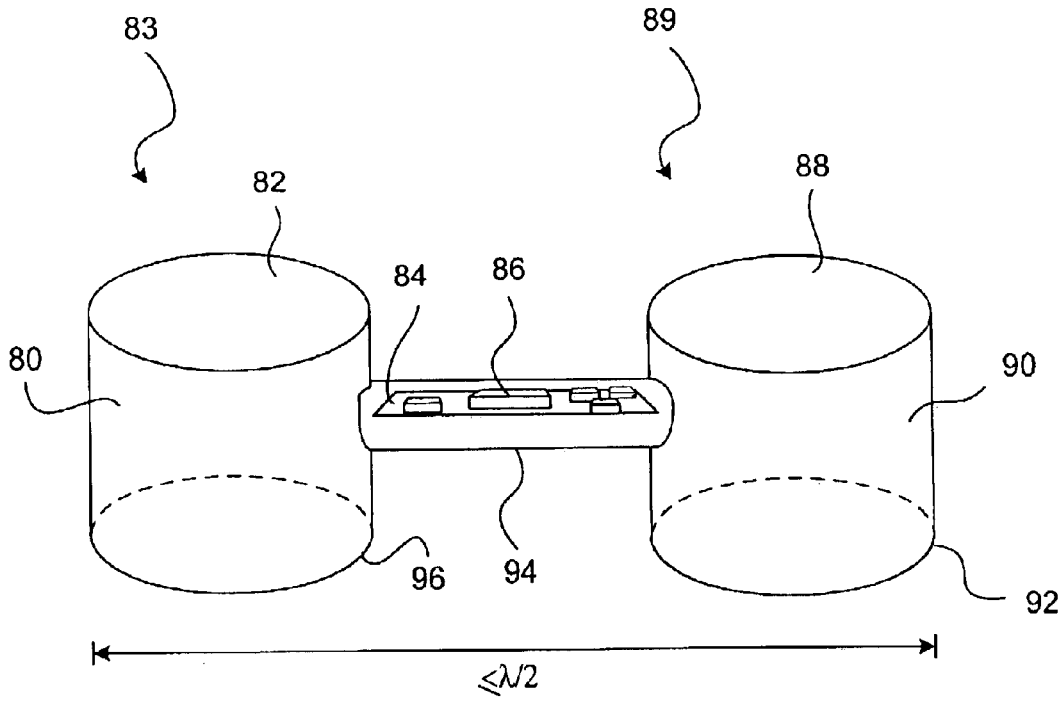
FIG. 5 illustrates an embodiment of a dumbbell shaped antenna with cylindrical pole elements connected by an interconnect structure, which encloses a printed circuit board.

FIG. 5 is an embodiment of a dumbbell shaped antenna with hollow radiating cylindrical pole elements connected by an interconnect structure, which encloses a printed circuit board. The first pole element 83 includes a top face 82, a side wall 80, and a bottom face 96. The second pole element 89 includes a top face 88, a side wall 90, and a bottom face 92. The interconnect 94 mechanically joins the pole element 83 to the pole element 89. The interconnect 94 also encloses a printed circuit board 84, which supports electronic components such as an electronic component 86. The antenna of FIG. 5 is constructed similar to the antenna described in FIG. 2, but places the printed circuit board 84 in the interconnect 94, which eliminates the need for the interconnect wiring shown in FIG. 3A. Instead, the wiring preferably resides on or in the printed circuit board 84. At the same time, this antenna still needs connection to the high-side and low-side transceiver outputs as discussed in connection with FIG. 3A. The materials, the geometric shapes of the pole elements, and the manufacturing techniques would be as described in the specification accompanying FIG. 2. Further, as shown in FIG. 5, the length of the antenna is preferably $\leqq\lambda/2$, where $\lambda$ is the wavelength of the radiation propagated by the antenna.

Figure 6:
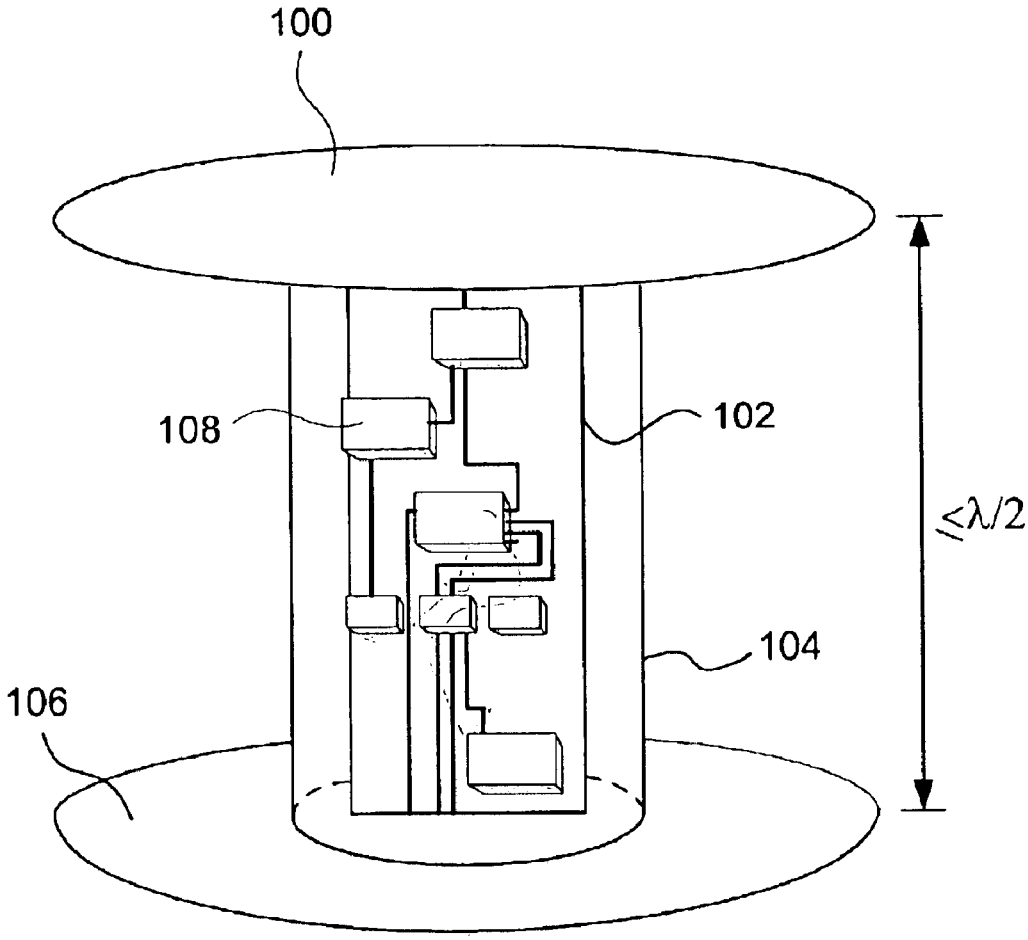
FIG. 6 illustrates an embodiment of a dumbbell shaped antenna with thin radiating disk pole elements connected by an interconnect structure, which encloses a printed circuit board.

FIG. 6 illustrates an embodiment of a dumbbell shaped antenna with thin radiating disks connected by an interconnect structure, which encloses a printed circuit board. The antenna of FIG. 6 is constructed similar to the antenna described in FIG. 5, but employs thin radiating disks for the pole elements, which can reduce the horizontal footprint of the antenna in certain applications. The antenna includes a radiating disk shaped pole element 100 and a radiating disk shaped pole element 106. The interconnect structure 104 connects radiating disk shaped pole elements 100, 106, and encloses printed circuit board 102 supporting components such as electronic component 108. Again, the length of the antenna is preferably $\leqq\lambda/2$, where $\lambda$ is the wavelength of the radiation propagated by the antenna.

Figure 7:
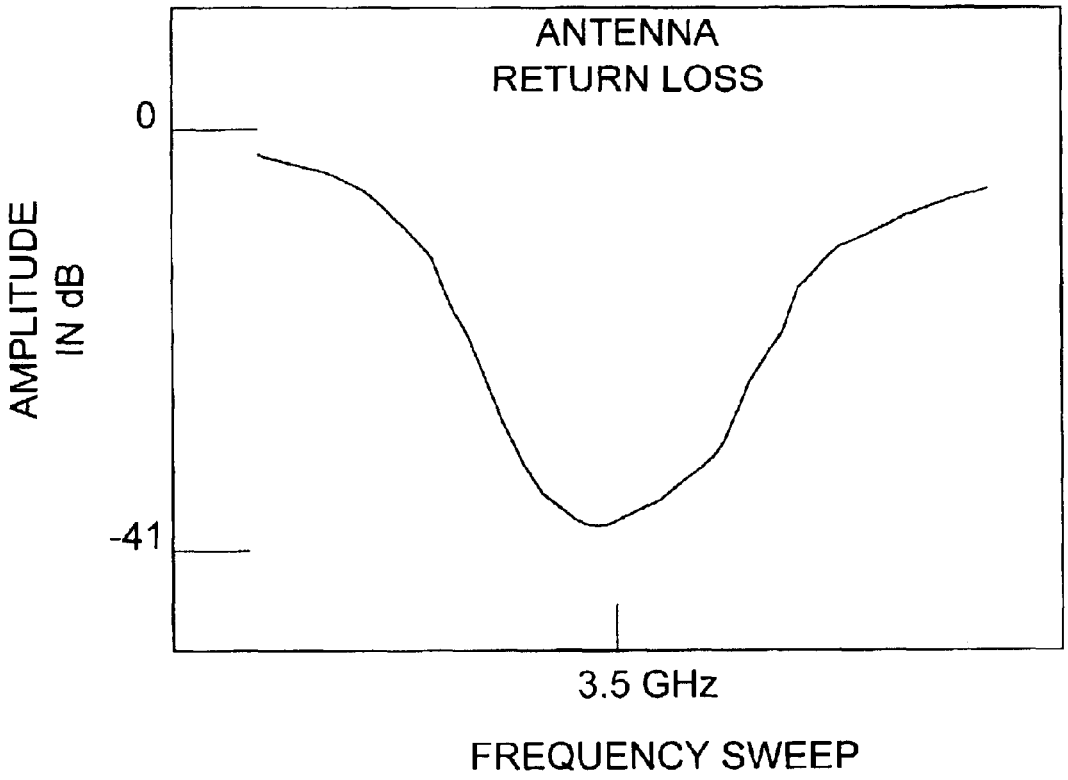
FIG. 7 illustrates an antenna return loss that might be expected from the embodiment of the antenna shown in FIG. 2.

FIG. 7 illustrates the antenna return loss expected from an embodiment of the antenna as shown in FIG. 4A. The dimensions of the antenna should be about 5 cm by 5 cm by 8 mm. In this antenna embodiment, an insulator replaces the photonic bandgap structure 66 shown in FIG. 4B. Antenna return loss is the ratio of the signal power provided to the antenna to the signal power reflected by the antenna. The best possible return loss ratio is 1:1 which means no signal power is reflected by the antenna. The data shown should be obtainable using a Hewlett Packard 8753D Network Analyzer. The antenna should be at least three feet away from all objects that could affect the return loss, when the measurements are taken. The return loss curve as shown in FIG. 7 is that expected of a typical resonant antenna, in this case the lowest return loss should be in the order of −41 dB (the return loss ratio in decibels expected as indicated by the HP 8753D analyzer).

What is claimed is:

1. An antenna for a wireless device, comprising:

a first pole element;

a second pole element;

electronic components; and an interconnect structure, which mechanically joins the first pole element to the second pole element, wherein the first pole element, the second pole element, or the interconnect structure enclose the electronic components, and wherein the combination of the first pole element, the second pole element and the interconnect structure define a mechanical package shield antenna with no protruding antenna pole elements.

2. The antenna of claim 1, wherein the first pole element and the second pole element and the interconnect structure are conductive to function as a dipole antenna.

3. The antenna of claim 1, further comprising a photonic band gap disposed between the first pole element and the second pole element, wherein the photonic band gap conducts so as to function as an electromagnetic shield when irradiated by electromagnetic radiation outside the frequencies selected for antenna propagation and as an insulator inside the frequencies selected for antenna propagation.

4. The antenna of claim 1, wherein the interconnect structure is spaced from the first pole element by an insulator and conductively connected to the second pole element.

5. The antenna of claim 1, wherein the first and second pole elements are a closed surface figure selected from the group of a cube, a rectangular prism, a square pyramid, a cylinder, a right circular cone, or a sphere.

6. The antenna of claim 1, wherein the length of the antenna is $\leqq\lambda/2$, wherein $\lambda$ is the wavelength of the radiation propagated by the antenna.

7. An antenna for a wireless device, comprising:

a first pole element;

a second pole element;

a printed circuit board; and an interconnect structure, which mechanically joins the first pole element to the second pole element, wherein the printed circuit board is enclosed in the first pole element, the second pole element, and/or the interconnect structure, which together define a mechanical package and an electromagnetic shield against any electromagnetic radiation, wherein the first pole element and the second pole element and the interconnect structure are conductive to function as a dipole antenna.

8. The antenna of claim 7, further comprising a photonic band gap disposed between the first pole element and the second pole element, wherein the photonic band gap conducts so as to function as an electromagnetic shield when irradiated by electromagnetic radiation outside the frequencies selected for antenna propagation and as an insulator inside the frequencies selected for antenna propagation.

9. The antenna of claim 7, wherein the interconnect structure is spaced from the first pole element by an insulator and conductively connected to the second pole element.

* * * * *